US009016499B2

(12) United States Patent
Scholz et al.

(10) Patent No.: US 9,016,499 B2
(45) Date of Patent: Apr. 28, 2015

(54) ADAPTER FOR AN OIL FILLER NECK AND ASSEMBLY METHOD FOR THE ADAPTER

(71) Applicant: GM Global Technology Operations LLC, Detroit, MI (US)

(72) Inventors: Peter Scholz, Mainz-Kastel (DE); Markus Luethen, Mainz (DE)

(73) Assignee: GM Global Technology Operations LLC, Detroit, MI (US)

( * ) Notice: Subject to any disclaimer, the term of this patent is extended or adjusted under 35 U.S.C. 154(b) by 103 days.

(21) Appl. No.: 13/871,927

(22) Filed: Apr. 26, 2013

(65) Prior Publication Data

US 2013/0306631 A1 Nov. 21, 2013

(30) Foreign Application Priority Data

Apr. 27, 2012 (DE) ..... 10 2012 008 418

(51) Int. Cl.
*B65D 41/06* (2006.01)
*F01M 11/04* (2006.01)
*B65D 51/00* (2006.01)

(52) U.S. Cl.
CPC ... *F01M 11/0458* (2013.01); *F01M 2011/0491* (2013.01)

(58) Field of Classification Search
USPC ..... 220/86.2, 86.1, 287, 293
See application file for complete search history.

(56) References Cited

U.S. PATENT DOCUMENTS

| | | | | |
|---|---|---|---|---|
| 3,951,297 | A * | 4/1976 | Martin | 220/86.3 |
| 4,114,779 | A * | 9/1978 | Stoll, III | 220/288 |
| 4,583,668 | A * | 4/1986 | Maynard, Jr. | 222/529 |
| 6,585,128 | B2 * | 7/2003 | Clevenger et al. | 220/303 |
| 6,880,593 | B1 * | 4/2005 | Swane | 141/286 |
| 8,066,132 | B2 * | 11/2011 | Swift et al. | 215/332 |
| 8,622,102 | B2 * | 1/2014 | Yager et al. | 141/350 |
| 8,714,213 | B2 * | 5/2014 | Girgenrath | 141/350 |
| 2005/0184024 | A1 * | 8/2005 | Santa Cruz et al. | 215/227 |
| 2008/0128415 | A1 * | 6/2008 | O'Connell | 220/86.2 |
| 2011/0100985 | A1 * | 5/2011 | Tsiberidis | 220/86.2 |
| 2012/0012583 | A1 * | 1/2012 | Novak et al. | 220/202 |
| 2013/0270266 | A1 * | 10/2013 | Lee | 220/212 |

FOREIGN PATENT DOCUMENTS

| | | | |
|---|---|---|---|
| DE | 69811401 | T2 | 11/2003 |
| DE | 102008004084 | A1 | 7/2009 |
| WO | 0111205 | A1 | 2/2001 |

* cited by examiner

*Primary Examiner* — Mickey Yu
*Assistant Examiner* — Niki Eloshway
(74) *Attorney, Agent, or Firm* — Ingrassia Fisher & Lorenz, P.C.

(57) ABSTRACT

An adapter for an oil filler neck and an assembly method for the adapter are provided. In an embodiment, the adapter includes an extension piece with a lower partial region and an upper partial region. The lower partial region has an outer bayonet cap guide that is adjusted to an inner bayonet cap guide of an oil fill port. The upper partial region has the inner bayonet cap guide that is adjusted to the outer bayonet cap guide of an oil filler inlet cover. An outer retaining ferule with an anti-twist device apron engages an outer edge region of the oil fill port in a positive and torsionally rigid manner.

10 Claims, 5 Drawing Sheets

ADAPTER FOR AN OIL FILLER NECK AND ASSEMBLY METHOD FOR THE ADAPTER

CROSS-REFERENCE TO RELATED APPLICATION

This application claims priority to German Patent Application No. 10 2012 008 418.8, filed Apr. 27, 2012, which is incorporated herein by reference in its entirety.

TECHNICAL FIELD

The technical field relates to an adapter for an oil filler neck and an assembly method for the adapter.

BACKGROUND

Known from publication DE 10 2008 004 084 A1 is a lock mounting fixture as well as a locking device for a filler opening, in particular for an oil filler opening in a vehicle. The known lock mounting fixture is intended to prevent a faulty operation of the locking device, in particular an unnoticeably loosely fitting oil filler cap. Provided for this purpose is a lockout, which prevents a locking motion by the oil filler cap if the oil filler cap is not in its starting locking position.

At least one object herein is to improve the approach and access to a deeply situated oil inlet port, and provide an adapter that can be assembled with a few hand movements, and that remains undetachably joined with the oil inlet port after assembly. In addition, other objects, desirable features and characteristics will become apparent from the subsequent summary and detailed description, and the appended claims, taken in conjunction with the accompanying drawings and this background.

SUMMARY

In accordance with an exemplary embodiment, an adapter for an oil filler neck is provided. The adapter exhibits an extension piece with a lower partial region and an upper partial region. The lower partial region exhibits an outer bayonet cap guide, which is adjusted to an inner bayonet cap guide of the oil fill port. The upper partial region exhibits the inner bayonet cap guide, which is adjusted to the outer bayonet cap guide of an oil filler inlet cover. An outer retaining ferule exhibits an anti-twist device apron, which engages an outer edge region of the oil fill port in a positive and torsionally rigid manner.

The adapter can be reliably and quickly assembled with the help of the retaining ferule. The adapter also shifts the oil fill port in a plane where an oil filler inlet cover can be conveniently and reliably handled. Having the upper partial region of the extension piece displace the bayonet cap for securing an oil filler inlet cover into an assembly plane that at least corresponds with the upper side of the plastic engine cover diminishes the risk of incorrect oil filler inlet cover attachment, i.e., skewed oil filler inlet cover placement, thereby virtually precluding a reliable locking by the bayonet cap. This risk exists in particular if the oil inlet port is difficult to get at, and situated deep in a plastic engine cover. In addition, it can avoid having to install technically complicated lockouts, which do not make it easier for the user to secure an oil filler inlet cover, but rather make it more difficult, since the lockouts force him or her to continue trying to secure the oil filler inlet cover until a permitted starting locking position has finally been found.

In an embodiment, the upper partial region can exhibit at least one axially aligned outer actuator spring, which is engaged with an axially aligned inner longitudinal slot of the retaining ferule so as to be torsionally rigid and axially displaceable. As a result, while the retaining ferule can be advantageously moved virtually up and down axially along the upper partial region, it cannot be twisted relative to the extension piece. Instead, as the bayonet cap of the extension piece is being twisted into the inner bayonet guide of the deep oil inlet port in the plastic engine hood, the retaining ferule is rotated along with the upper partial region of the extension piece.

Only after the bayonet cap has been latched between the oil inlet port and lower partial region of the extension piece will a position have been reached in which axially displacing the retaining ferule in the direction toward the oil inlet port in the engine cover enable an axial displacement of the anti-twist device apron in a tight fit with an edge region of the oil inlet port. Interaction between the actuator spring of the upper section of the adapter and the corresponding axially aligned inner longitudinal slot of the ferule advantageously allows the anti-twist device apron to reach its tightly-fitting position.

In a further embodiment, the retaining ferule has distributed on its periphery engagement hooks, which in conjunction with the lower partial region form an undetachable thrust bearing for the adapter, ensuring that, while opening and closing the upper bayonet cap between the upper partial region of the extension piece and an oil filler inlet cover, the closed bayonet cap cannot be opened between the lower partial region of the extension piece and the oil inlet port.

In another embodiment, the oil filler inlet cover can exhibit an annular groove, which is located between its edge-side outer bayonet cap guide and an overhanging oil filler inlet cover, and incorporates an annular sealing element that operatively interacts with an inner wall of the upper partial region of the extension piece of the adapter in a media-tight manner. The advantage is that, when the oil filler inlet cover is applied to the adapter above the bayonet cap for the oil filler inlet cover, there is a media-tight termination relative to the inner wall of the upper partial region, which allows the oil filler inlet cover to establish a media-tight seal.

In an embodiment, the lower partial region exhibits a flange that hangs over the oil fill port, and is bonded with a corresponding lower flange of the upper partial region. The bonded connection produces the single-piece extension piece of the adapter from the two partial regions, for example by welding the plastic materials of the upper partial region and lower partial region. The advantage to this extension piece is that the adapter can be placed on any standardized oil fill port with a corresponding inner bayonet cap guide as a function of the vehicle model, thereby bringing the inlet cap into a position easily accessible by the vehicle user, and thus preventing accidental misuse of the oil filler inlet cover. In addition, the overhanging flanges help ensure a secure fit of the adapter on the oil fill port.

In another embodiment, the overhanging flange and outer bayonet cap guide of the lower partial region have arranged between them an annular groove, in which an annular sealing element operatively interacts with the inner wall of the oil filler neck in a media-tight manner. The arrangement of a sealing element in this region enables the media-tight attachment of the adapter to the oil fill port of the oil filler neck.

In accordance with an exemplary embodiment, an assembly method for an adapter for an oil filler neck exhibits the following procedural steps. The adapter is first prepared as described above out of an extension piece, which has a lower and upper partial region bonded together by flanges. A retaining ferule with an anti-twist device apron is then brushed onto the extension piece of the adapter along at least one axially aligned actuator spring of the upper partial region by means of an axially designed longitudinal slot of the retaining ferule.

The lower partial region of the adapter with an outer bayonet cap guide can then be axially introduced into an inner bayonet of an oil fill port of the oil filler neck. The extension piece is subsequently turned along with the retaining ferule, accompanied by the closure of the bayonet cap between the lower partial region and the oil fill port. Finally, as a safeguard against twisting, the retaining ferule is axially displaced, with the anti-twist device apron of the retaining ferule becoming latched on an edge region of the oil filler neck in a form fitting manner.

As a consequence, the extending adapter can be quickly and reliably installed in a few assembly steps, while simultaneously ensuring that the bayonet cap between the inlet opening and lower partial region of the extension piece cannot become detached while fastening an oil filler inlet cover onto the adapter.

In another embodiment, also provided is another procedural step in which engagement hooks distributed on the periphery of the retaining ferule are undetachably engaged with a flange of the lower partial region overhanging the oil inlet port after the retaining ferule has been axially aligned. These engagement hooks ensure that the anti-twist device apron remains with the adapter tightly latched on the oil inlet port.

In a further embodiment, an annular sealing element is incorporated into an annular groove of the lower partial region of the adapter and, while axially introducing the lower partial region of the adapter into an inner bayonet cap guide of the oil fill port of the oil filler neck, establishes a media-tight contact to an inner wall of the filler neck.

In another embodiment of the assembly method, an oil filler inlet cover is axially introduced into the upper partial region, and twisted into the inner bayonet cap guide of the upper partial region while engaging an outer bayonet cap guide of the oil filler inlet cover.

While axially introducing the oil filler inlet cover into an inner bayonet cap guide of the upper partial region of the extension piece of the adapter, an annular sealing element in an annular groove of the oil filler inlet cover ensures that the upper partial region of the adapter can be sealed media-tight relative to an inner wall of the upper partial region by means of the oil filler inlet cover.

In addition, the undetachably secured retaining ferule can prevent the bayonet cap from detaching between the oil filler neck and lower partial region of the extension piece when putting on and taking off the oil filler inlet cover.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description.

Figure 1:
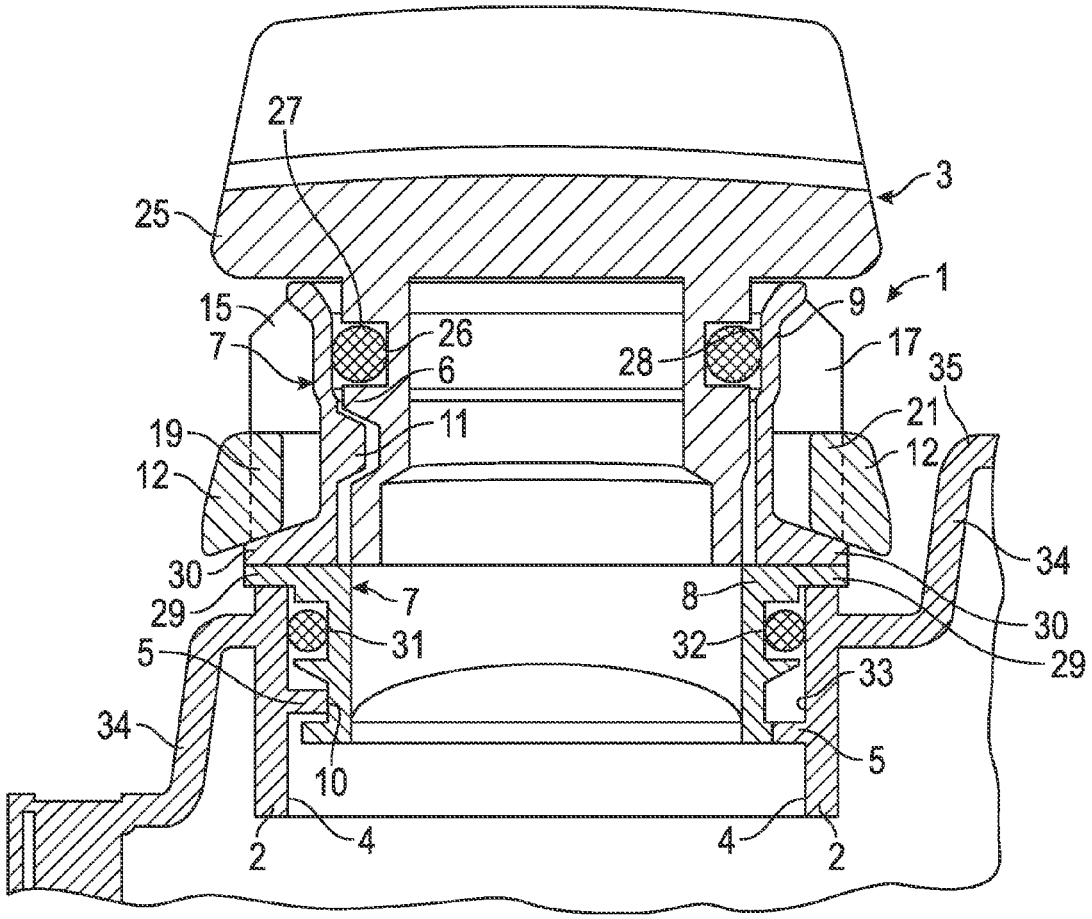
FIG. 1 shows a schematic cross sectional view through an adapter for an oil filler neck in accordance with an exemplary embodiment.

FIG. 1 shows a schematic cross section through an adapter 1 for an oil filler neck 2. In this embodiment of the invention, the oil filler neck 2 is provided in an engine cover 34, and recessed in relation to the outer contour 35 of the plastic motor cover 34 in such a way that problems may be encountered when securing an oil filler inlet cover 3 onto the oil filler neck 2 of the engine cover 34.

In accordance with an exemplary embodiment, the adapter 1 exhibits an extension piece 7 consisting of a lower partial region 8, which projects into the oil filler neck 2, and an upper partial region 9, which protrudes over the contour 35 of the motor cover 34. The upper partial region 9 exhibits a lower flange 30, and the lower partial region 8 exhibits an upper flange 29. The flanges 29 and 30 of the partial regions 8 and 9 are tightly bonded with each other, and thereby form the one-piece extension piece 7.

The tightly bonded flanges 29 and 30 of the lower partial region 8 or upper partial region 9 here overhang an oil fill port 4 of the oil filler neck 2, and thus rest on the oil filler neck 2 of the motor cover 34. This rest position is secured by an edge-side inner bayonet cap guide 5 of the oil filler neck 2 intermeshing with an edge-side outer bayonet cap guide 10 of the inner partial region 8, if the lower partial region 8 of the extension piece 7 engages the oil filler neck 9 following the axially aligned introduction of the extension piece 7 into the oil filler neck 2 and subsequent twisting of the bayonet cap guides 5 and 10 relative to each other.

The upper partial region 9 of the extension piece 7 exhibits an inner bayonet cap guide 11, which can be made to engage an edge-side outer bayonet cap guide 6 of the oil filler inlet cover 3. Provided to secure the lower bayonet cover situated in the oil filler neck 2 against twisting is a retaining ferule 12, whose function and construction will be explained in greater detail on the following FIGS. 2 to 4.

In order to establish a media-tight seal between the extension piece 7 and oil filler neck 2, an annular groove 31 with an annular sealing element 32 is provided above the outer bayonet cap guide 10 of the lower partial region 8. The sealing element 32 establishes a media-tight contact to an inner wall 33 of the oil filler neck 2.

Another annular sealing element 27 is arranged in an annular groove 26 above the upper bayonet cap comprised of an outer bayonet cap guide 6 of the oil filler inlet cover 3 and inner bayonet cap guide 11 of the upper partial region 9 of the extension piece 7. Situated in the oil filler inlet cover 3 below an oil filler inlet cover cap 25 overhanging the upper partial region 9 of the extension piece 7 for this purpose is an annular groove 26, which incorporates the annular sealing element 27 of the oil filler inlet cover 3. The sealing element 27 establishes a media-tight contact with an inner wall 28 of the upper partial region 9 of the extension piece 7.

Figure 2:
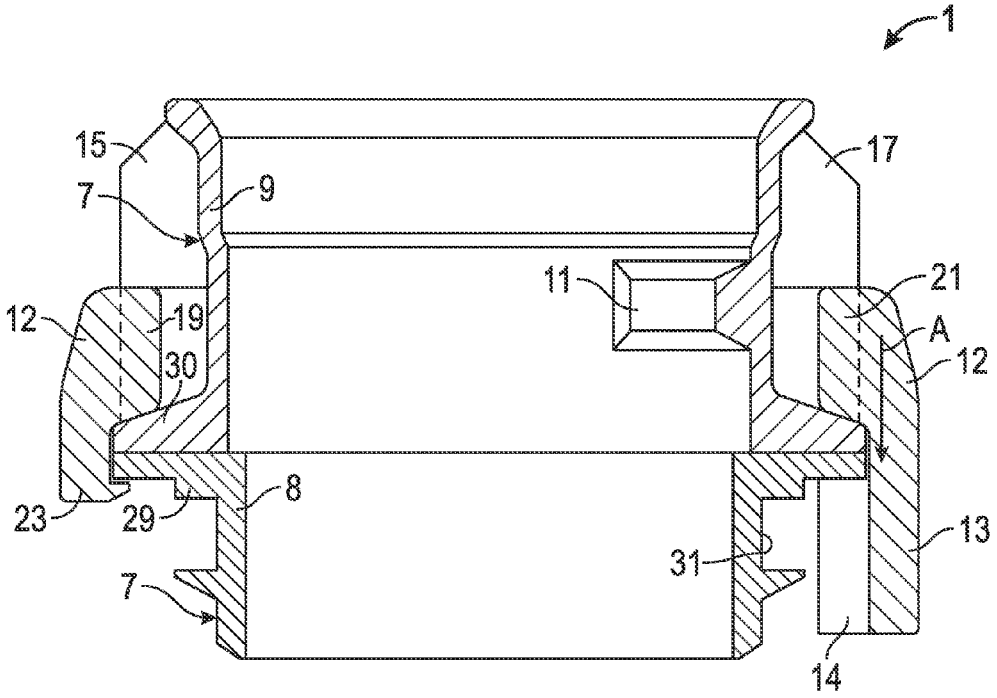
FIG. 2 shows a schematic cross sectional view through an extension piece with an upper and lower partial region of the adapter according to FIG. 1.

In accordance with an exemplary embodiment, FIG. 2 shows a schematic cross section through the extension piece 7 with an upper and lower partial region 8 or 9 of the adapter 1 according to FIG. 1. The function and arrangement of the retaining ferule 12 becomes visible from FIG. 2. The retaining ferule 12 envelops the extension piece 7, and can be slipped onto the extension piece 7 in an axial direction. To this end, the upper partial region 9 of the extension piece 7 exhibits axially aligned actuator springs 15 and 17, which are engaged with longitudinal slots 19 and 21 on the retaining ferule 12 so as to be axially displaceable and torsionally rigid.

The actuator springs 15 and 17 are outwardly attached to the upper partial region 9 of the extension piece 7, and form an axial actuator spring guide for the retaining ferule 12. At the same time the retaining ferule 12 is axially slipped on in the direction of arrow A, an anti-twist device apron 13 projecting over the flanges 29 and 30 is moved downward in the direction of arrow A until the anti-twist device apron 13 is able to establish a tight fit with an outer edge region 14 of the oil filler neck depicted on FIG. 1. The retaining ferule 12 also has three engagement hooks 23 distributed on its periphery.

Figure 3:
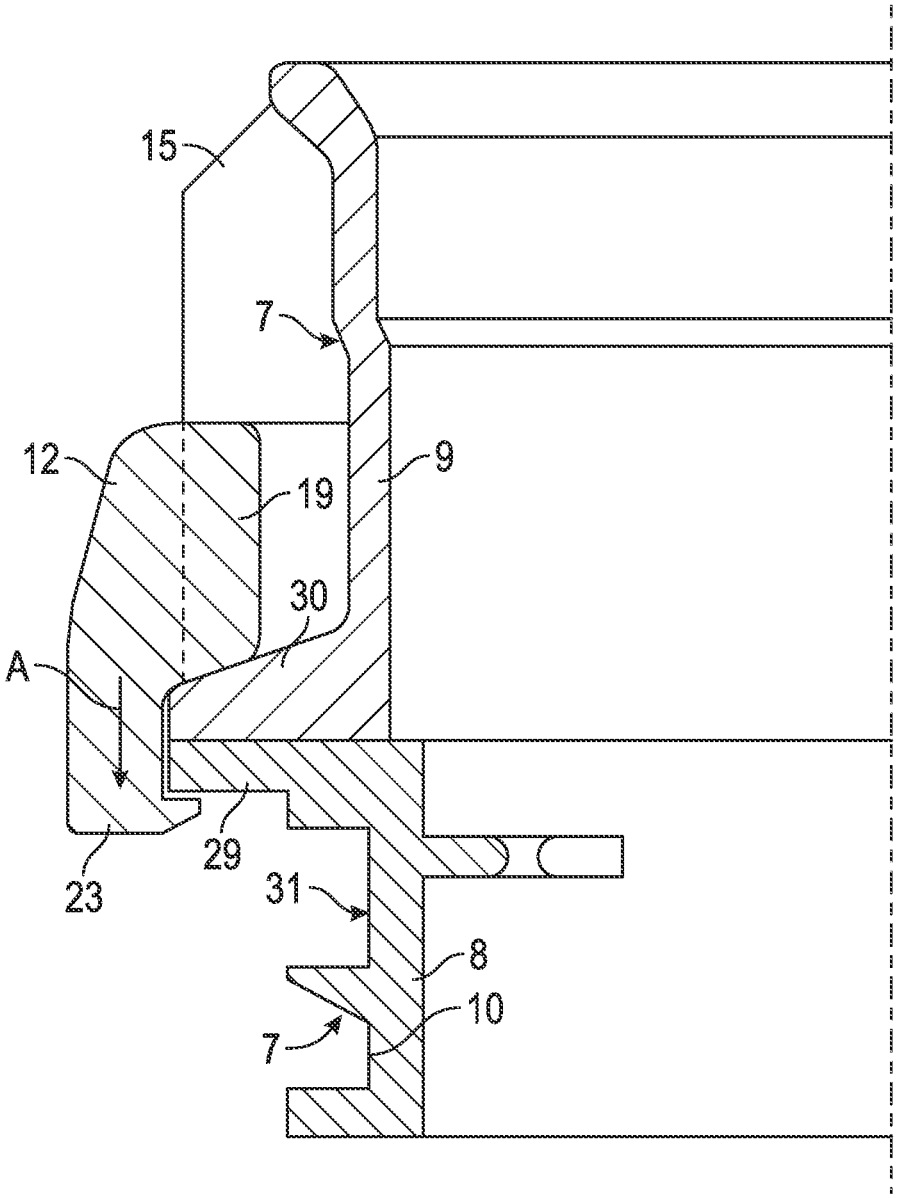
FIG. 3 shows a detailed, schematic cross sectional view through the extension piece according to FIG. 2.

In accordance with an exemplary embodiment, FIG. 3 shows a detailed schematic cross section through the extension piece 7 according to FIG. 2 in the area of one of the engagement hooks 23. Components having the identical functions as on the preceding figures are labeled with the same reference numbers, and will not be explained further. The engagement hooks 23 can be engaged with the tightly bonded flanges 29 and 30 of the lower partial region 8 or upper partial region 9 by axially displacing the retaining ferule 12 along the actuator spring 15 in the direction of arrow A. Once the retaining ferule 12 has engaged the tightly bonded flanges 29 and 30 of the lower partial region 8 or upper partial region 9 of the extension piece 7 as depicted on FIG. 3, the anti-twist device apron 13 of the retaining ferule 12 shown on FIG. 2 is also undetachably latched in its form-fitting locked position, since the engagement hooks 23 are undetachable.

Figure 4:
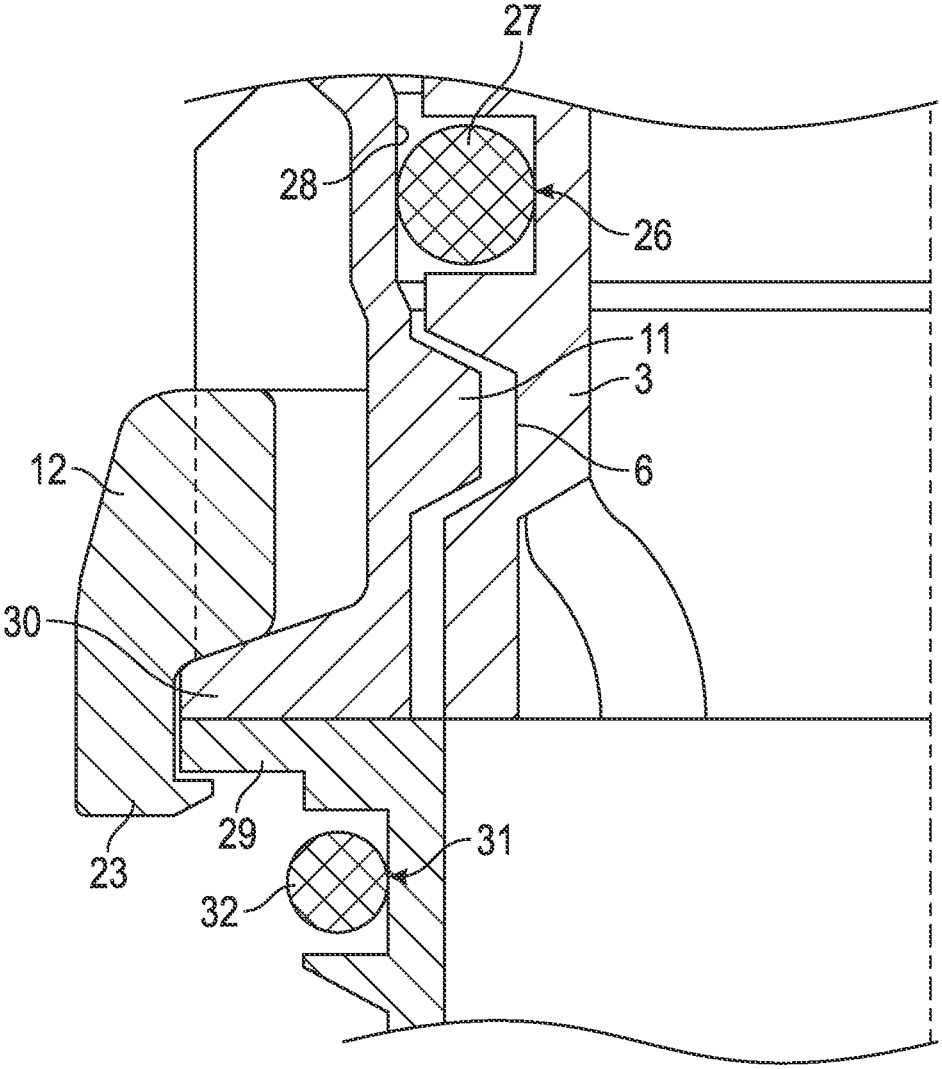
FIG. 4 shows a schematic cross sectional view through the extension piece according to FIG. 3 with the oil filler inlet cover introduced.

FIG. 4 shows a detailed schematic cross section through the extension piece 7 according to FIG. 3 with the oil filler inlet cap 3 introduced, in accordance with an embodiment. As clearly evident from FIG. 4, once the engagement hooks 23 distributed on the periphery of the retaining ferule 12 have latched, the retaining ferule 12 is undetachably joined with the extension piece 7 of the adapter, so that the adapter can only be removed from the oil filler neck depicted on FIG. 1 by destroying the ferule 12, since the anti-twist device apron 13 shown on FIG. 2 is simultaneously in its form-fitting locked position. FIG. 4 also illustrates the position of the two sealing elements 27 and 32 in the upper or lower region of the adapter.

Figure 5:
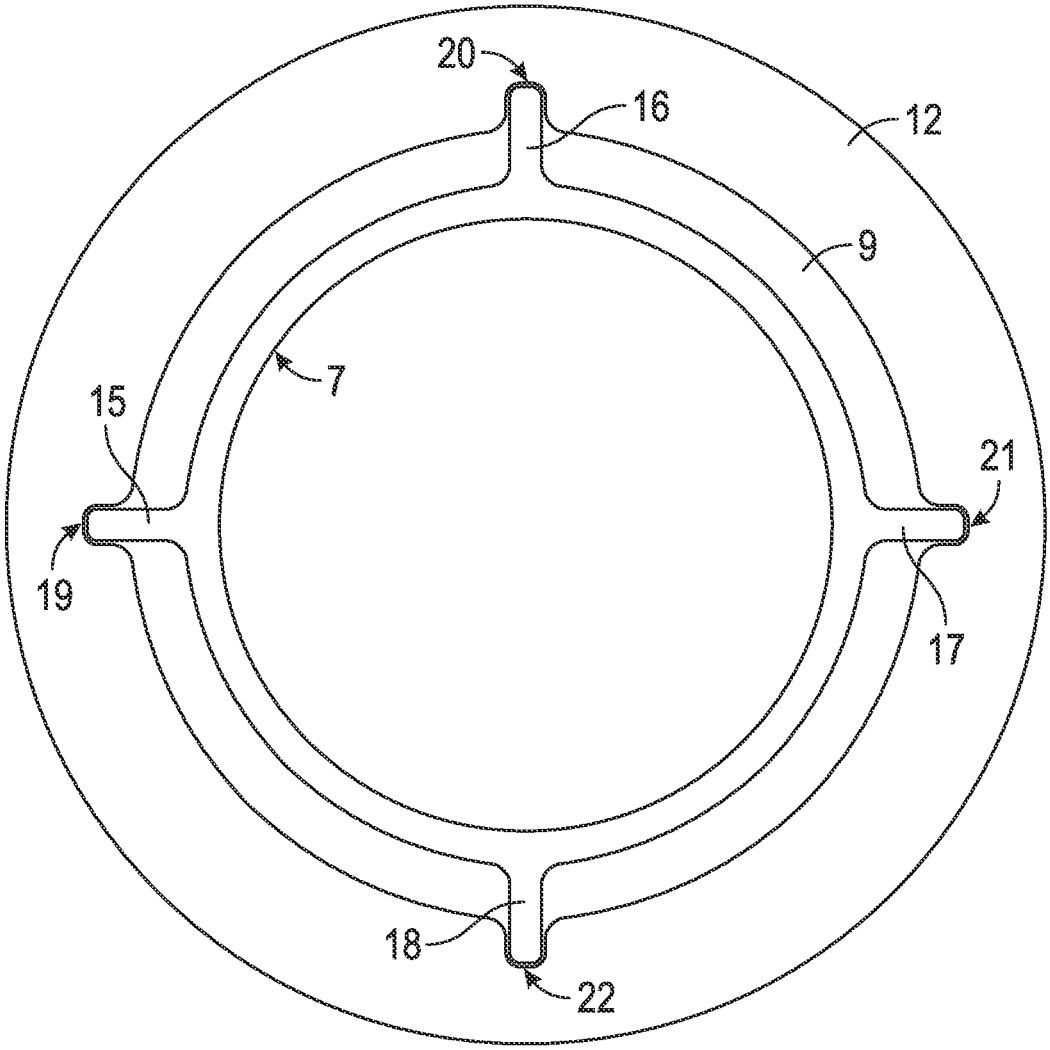
FIG. 5 shows a schematic top view of the retaining ferule and upper partial region of the extension piece of the adapter of FIG. 1.

In an embodiment, FIG. 5 shows a schematic top view of the retaining ferule 12 and upper partial region 9 of the extension piece 7. This top view depicts the arrangement of four axially aligned actuator springs 15, 16, 17 and 18 distributed on the periphery of the upper partial region 9 of the extension piece 7. The actuator springs 15, 16, 17 and 18 are engaged with the inner longitudinal slots 19, 20, 21 and 22 of the retaining ferule 12, which are aligned in an axial direction. The actuator springs 15, 16, 17 and 18 and the longitudinal slots 19, 20, 21 and 22 cause the retaining ferule 12 to also rotate while tightening the extension piece 7 in the oil filler neck 2 depicted on FIG. 1.

The retaining ferule 12 with its longitudinal slots 19, 20, 21 and 22 can further be displaced in an axial direction along the actuator springs 15, 16, 17 and 18 of the upper partial region 9. The anti-twist device apron 13 of the retaining ferule 12 shown on FIG. 2 can here be displaced so as to form-fittingly engage the outer region of the oil filler neck. The retaining ferule 12 remains joined in a torque-proof manner with the upper partial region 9 of the extension piece 7 of the adapter in the form-fittingly engaged position of the anti-twist device apron due to the torque-proof actuator spring-longitudinal slot connection, so that the anti-twist device apron 13 depicted on FIG. 2 can be brought to a form-fitting, undetachable position with an edge region 14 of the filler neck 2 shown on FIG. 1.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An adapter for an oil filler neck, wherein the adapter comprises:

an extension piece with a lower partial region and an upper partial region, wherein the lower partial region comprises an outer bayonet cap guide that is adjusted to an inner bayonet cap guide of an oil fill port, and wherein the upper partial region comprises the inner bayonet cap guide that is adjusted to the outer bayonet cap guide of an oil filler inlet cover, and an outer retaining ferule that comprises an anti-twist device apron, which engages an outer edge region of the oil fill port in a positive and torsionally rigid manner, wherein the retaining ferule has distributed on its periphery engagement hooks, which can be detachably engaged with the lower partial region if the adapter is engaged with the inner bayonet cap guide of the oil fill port.

2. The adapter according to claim 1, wherein the upper partial region comprises an axially aligned outer actuator spring that engages an axially aligned inner longitudinal slot of the retaining ferule so as to be torsionally rigid and axially displaceable.

3. The adapter according to claim 1, wherein the oil filler inlet cover comprises an annular groove that is located between the outer bayonet cap guide and an overhanging oil filler inlet cover cap, and incorporates an annular sealing element that operatively interacts with an inner wall of the upper partial region in a media-tight manner.

4. The adapter according to claim 1, wherein the lower partial region comprises a flange that hangs over the oil fill port, and is bonded with a corresponding lower flange of the upper partial region.

5. The adapter according to claim 4, wherein the lower partial region exhibits an annular groove between the overhanging flange and the outer bayonet cap guide, which incorporates an annular sealing element that operatively interacts with an inner wall of the oil filler neck in a media-tight manner.

6. An assembly method for an adapter for an oil filler neck, wherein the method comprises the steps of:

preparing an adapter from an extension piece that has a lower and upper partial region that are bonded together;

brushing a retaining ferule with an anti-twist device apron onto the extension piece of the adapter along an axially aligned actuator spring of the upper partial region, which is arranged in an axially aligned longitudinal slot of the retaining ferule;

axially introducing the lower partial region of the adapter with an outer bayonet cap guide into an inner bayonet cap guide of an oil fill port of the oil filler neck;

turning the extension piece along with the retaining ferule, accompanied by the closure of the bayonet cap between the lower partial region and the oil fill port; and axially displacing the retaining ferule, with the anti-twist device apron becoming latched in an edge region of the oil filler neck in a form fitting manner.

7. The assembly method according to claim 6, further comprising undetachably engagement hooks of the retaining ferule with a flange of the lower partial region hanging over the oil inlet port.

8. The assembly method according to claim 6, further comprising axially introducing the lower partial region of the adapter into the inner bayonet cap guide of the oil fill port of the oil filler neck during which a sealing element in an annular groove of the lower partial region of the adapter establishes a media-tight contact to an inner wall of the filler neck.

9. The assembly method according to claim 6, wherein an oil filler inlet cover is axially introduced in the upper region, and twisted into the inner bayonet cap guide of the upper partial region while engaging an outer bayonet cap guide of the oil filler inlet cover.

10. An adapter for an oil filler neck, wherein the adapter comprises:

an extension piece with a lower partial region and an upper partial region, wherein the lower partial region comprises an outer bayonet cap guide that is adjusted to an inner bayonet cap guide of an oil fill port, and wherein the upper partial region comprises the inner bayonet cap guide that is adjusted to the outer bayonet cap guide of an oil filler inlet cover, and an outer retaining ferule that comprises an anti-twist device apron, which engages an outer edge region of the oil fill port in a positive and torsionally rigid manner, wherein the upper partial region comprises an axially aligned outer actuator spring that engages an axially aligned inner longitudinal slot of the retaining ferule so as to be torsionally rigid and axially displaceable.

* * * * *